US008789803B2

(12) United States Patent
Van Wingerden et al.

(10) Patent No.: US 8,789,803 B2
(45) Date of Patent: Jul. 29, 2014

(54) SLIDING MAILBOX STRUCTURE HAVING TWO-PIECE CONSTRUCTION AND HANDLE

(76) Inventors: James Richard Van Wingerden, Grand Rapids, MI (US); Mary Ellen Van Wingerden, Grand Rapids, MI (US)

( * ) Notice: Subject to any disclaimer, the term of this patent is extended or adjusted under 35 U.S.C. 154(b) by 0 days.

(21) Appl. No.: 13/532,854

(22) Filed: Jun. 26, 2012

(65) Prior Publication Data

US 2013/0001386 A1 Jan. 3, 2013

Related U.S. Application Data

(60) Provisional application No. 61/502,126, filed on Jun. 28, 2011.

(51) Int. Cl.

| | |
|---|---|
| ***A47G 29/02*** | (2006.01) |
| ***E04G 3/20*** | (2006.01) |
| ***E06B 7/28*** | (2006.01) |

(52) U.S. Cl.

USPC ..... 248/244; 248/243; 232/29; 232/39; 232/17

(58) Field of Classification Search

USPC ..... 248/279.1, 284.1, 219.2, 219.3, 219.1, 248/241, 243, 244, 128; 232/29, 39, 17, 28, 232/30, 38

See application file for complete search history.

(56) References Cited

U.S. PATENT DOCUMENTS

| | | | | | |
|---|---|---|---|---|---|
| 2,723,098 | A | * | 11/1955 | Moore | 248/128 |
| 3,497,078 | A | * | 2/1970 | Nash | 211/79 |
| 3,870,262 | A | * | 3/1975 | Manning, Jr. | 248/145 |
| 4,484,705 | A | * | 11/1984 | Sande | 232/39 |
| 4,496,123 | A | * | 1/1985 | Laramie | 248/121 |
| 4,821,952 | A | * | 4/1989 | Deciutiis | 232/17 |
| 4,869,426 | A | * | 9/1989 | Powers et al. | 232/39 |
| 5,201,465 | A | * | 4/1993 | Limehouse | 232/35 |
| 5,356,072 | A | * | 10/1994 | Thomas | 232/39 |
| 5,435,412 | A | * | 7/1995 | Franklin et al. | 182/188 |
| 5,775,578 | A | * | 7/1998 | Baxi et al. | 232/17 |
| 6,161,756 | A | * | 12/2000 | Upton | 232/39 |
| 6,378,768 | B1 | * | 4/2002 | Belloise | 232/39 |
| 6,474,543 | B2 | * | 11/2002 | Grell | 232/38 |
| 6,543,680 | B1 | * | 4/2003 | McCormack | 232/39 |
| 6,955,291 | B1 | | 10/2005 | Knight | |
| 6,988,655 | B1 | | 1/2006 | Riccio | |
| 6,997,373 | B2 | * | 2/2006 | Flores | 232/29 |
| 7,090,118 | B2 | * | 8/2006 | Lackey et al. | 232/39 |
| 7,163,141 | B1 | * | 1/2007 | Parker | 232/39 |
| 7,210,616 | B1 | * | 5/2007 | Van Watermulen | 232/29 |
| 7,389,911 | B2 | * | 6/2008 | Ruocco | 232/39 |
| 8,042,729 | B2 | * | 10/2011 | Dinh | 232/29 |
| 8,087,573 | B2 | * | 1/2012 | Patterson et al. | 232/1 C |

(Continued)

*Primary Examiner* — Nkeisha Smith

(74) *Attorney, Agent, or Firm* — Daniel Boudwin; Global Intellectual Property Agency LLC

(57) ABSTRACT

Disclosed is a mailbox slider device that provides mailboxes of various widths to be slideably mounted along the horizontal portion of an existing mailbox support post. The device comprises a first base member and a second slideable member being attached using complimentary tongue and groove sliders, wherein the members include a recessed channel having a first and second channel stop that prevents separation of the two members at the base member distal end, while allowing separation and engagement of the members along the inward proximal end of the base member. A mailbox is secured to a support block, which then attaches to the upper surface of the second sliding member. The sliding member engages the base member from its proximal end, whereafter the base member is secured to the horizontal portion of a mailbox post to provide a readily extendable and retractable assembly for improved access for postal service workers.

5 Claims, 3 Drawing Sheets

(56) References Cited

U.S. PATENT DOCUMENTS

| | | | | |
|---|---|---|---|---|
| 8,123,113 | B1 * | 2/2012 | Hartman | 232/39 |
| 2002/0130171 | A1 * | 9/2002 | Grell | 232/17 |
| 2004/0211827 | A1 * | 10/2004 | Gunvaldson | 232/19 |
| 2004/0234334 | A1 * | 11/2004 | King | 404/6 |
| 2005/0258227 | A1 * | 11/2005 | Flores | 232/29 |
| 2007/0193824 | A1 * | 8/2007 | Anderson | 182/8 |
| 2009/0196028 | A1 * | 8/2009 | Chao et al. | 362/183 |
| 2011/0210166 | A1 * | 9/2011 | Dinh | 232/17 |

* cited by examiner

SLIDING MAILBOX STRUCTURE HAVING TWO-PIECE CONSTRUCTION AND HANDLE

CROSS REFERENCE TO RELATED APPLICATION

This application claims the benefit of U.S. Provisional Application No. 61/502,126 filed on Jun. 28, 2011, entitled "Snow-Slider Mailbox Mount." The patent application identified above is incorporated here by reference in its entirety to provide continuity of disclosure.

BACKGROUND OF THE INVENTION

1. Field of the Invention

The present invention relates to mailboxes and access thereto in rural areas and those areas prone to annual snowfall accumulation. More specifically, the present invention pertains to a two-piece slider mechanism that mounts between an existing mailbox and mailbox post, wherein the mailbox is outwardly slideable from the post for access thereinto by postal workers while remaining in their vehicles. The present invention is designed for simplicity and to minimally impact the current procedure for mounting a mailbox to existing mailbox posts.

Typical mailbox assemblies are structure adapted to house delivered and outgoing mail for the postal service to access. These devices are well known structures that are commonly connected to upstanding mailbox posts and employ an outward opening facing the roadway, particularly in those suburban or rural areas wherein each residence is provided its own independent mailbox. These areas, however, may include streets or roadways having adjacent obstructions that limit access to the mailbox from the roadway, wherein a postal worker may be required to awkwardly reach from his or her vehicle or completely exit therefrom to address the mailbox. Further, those areas that are prone to annual snowfall are also prone to mailbox obstructions, wherein snow is plowed into large mounds along the sides of roadways, blocking access for vehicles to deviate from the roadway to reach the mailbox position.

Therefore, a mailbox structure or device is required that improves the means of accessing a stationed mailbox along the side of a roadway. The present invention is herein disclosed as a means of extending a mailbox's position from its attached location on a mailbox post to a position extended therefrom, wherein the distance between the mailbox opening and a postal service vehicle along the roadway is reduced for improved access thereinto. This facilitates postal service workers having access to a user's mailbox in rural areas, during periods of snow accumulation and in other instances wherein ready access to one's mailbox is limited from the adjacent roadway.

2. Description of the Prior Art

Devices have been disclosed in the prior art that relate to mailbox slider assemblies. These include devices that have been patented and published in patent application publications. These devices generally relate to assemblies that provide a means to extend a mailbox position, wherein the elements of the assembly are overly complex, include sliding mechanisms that are prone to high amounts of friction and thus resistant to sliding, and further devices that are not readily adapted for accepting mailboxes without radically changing their existing support structure. The present invention provides two sliding members that are joined along one end and secure together along a second end, the two members employing a low friction and simple means of relative motion therebetween. The present invention is adapted to mount below an existing mailbox and support block, and mount to an existing mailbox post having an upstanding portion and horizontal portion adapted to receive a mailbox thereon. The forgoing devices in the prior art deemed most relevant to the present disclosure are herein described for the purposes of highlighting and differentiating the unique aspects of the present invention, and further highlighting the drawbacks existing in the prior art.

Specifically, U.S. Pat. No. 6,543,680 to McCormack discloses a slide mount for a rural mailbox, comprising a plastic base having a complimentary horizontal slide member slideably connected thereto, along with a one-way stop that prevents the slide member from fully disengaging the base once installed. The base and slide member share a plurality of complimentary slots that form a slide path for relating sliding of the slide member with respect to the stationary base. The slots further comprise horizontally mounted tongue and groove locking and sliding members that connect the two members, wherein a deployable catch prevents the two from being removable from one another. The base is formed of an interior volume having the slots or slide channels, while the catching mechanism is spring loaded. The McCormack device, while describing a similar device and design for accepting a mailbox, involves a configuration that mounts the mailbox directly into its upper slide member and within a shelf defined by upstanding outer walls. Fasteners are driven through the sides of the mailbox and into to the outer walls of the slide member to secure the two together. This configuration requires the width of the mailbox to be complimentary to the width between the two outer walls of the slide member, wherein larger or smaller mailboxes will not fit or will be inwardly offset from the outer walls. The present invention utilizes vertically oriented fasteners that connect a support board mounted below the mailbox to the sliding member, whereby the width of the sliding member is not tied to the width of the mailbox itself. A mailbox of any width may work in conjunction with the present invention, wherein the sliding member does not enclose the mailbox within outer walls, but rather supports the mailbox from below and connects to an appropriately sized support board. Further, the catch mechanism of McCormack is one that diverges in design elements and intent from the present invention, wherein the present invention includes a slideable member comprising of no moving parts. A lateral side channel is provided having a freely engagable end and a pull-stop end that prevents separation of the sliding and base members while in use.

U.S. Pat. No. 4,496,123 to Laramie is another such device that discloses an extendable support for a mailbox, comprising a hollow, elongated support member and an extension arm that is a carrier for the mailbox and extends from the hollow interior of the support member. The hollow support member forms a recess into which the extension arm, attached to the mailbox, slides into and therefrom to retract and extend the mailbox as desired. An optional stop prevents complete dislodgment of the member and the arm. The Laramie device also describes a slideable mailbox mount, however the elements that form this mount and its structure diverge significantly from the present invention, which provides a readily engagable first and second member having a formed stop therebetween, wherein the number of moving or independent parts is minimized and the structure is readily deployable for any sized or configured mailbox structure.

Further, U.S. Pat. No. 6,988,655 to Riccio discloses a telescopic mailbox support, comprising an elongated and upstanding shaft connecting to a telescopic support member positioned orthogonally to the upstanding shaft. The support member includes a plurality of elongated tubes that are slideably engagable along a path for moving a mailbox between an extended and retracted position. A platform attaching to the inner most tube provides a means to support a mailbox along the end of the telescoping shaft, while the upstanding portion of the device provides the necessary offset from a support surface as is typical of mailbox posts. The Riccio device provides a telescoping support, which establishes a unique means of conveying a mailbox between a first and second position. However, this device includes a structure that is divergent from the present invention. It is submitted that a plurality of telescoping members may be more prone to seizure due to rust and debris, wherein the present invention provides a simplified structure that minimizes surface contact along the sliding and base member to reduce friction and provide a simply designed sliding support.

U.S. Pat. No. 6,955,291 to Knight describes an adjustable mailbox platform having a bracket attached to a plurality of space side members that attach to an existing mailbox post. The cross members are secured to the side member to maintain a stable position above the upstanding mailbox post, while an elongated support member is slideably engaged between the cross members, side members and the mailbox post. The support member can be retracted or extended through the assembly to reposition the mailbox as necessary for access purposes in rural areas. Similar to the Riccio and Laramie disclosures, the Knight device describes a device that offers a means of extension and retraction for a mailbox, wherein delivery of mail and access from a postal service vehicle is facilitated through the slideable action of the support means. However, the Knight device provides a structure that is divergent in elements from the present invention. The Knight device utilizes an overly elongated board upon which to slide through a confined area defined by its mailbox post support. No means of stopping the structure from disengaging the post is disclosed, and the device requires removal of a standard mailbox support horizontal support, in favor of a simple, upstanding post for which the Knight assembly to attached thereto.

Finally, U.S. Pat. No. 7,389,911 to Ruocco discloses a mailbox mounting device having three elongated and slideable members. The members are stacked upon one another and may be moved relative to one another and respective of an underlying member. The lowermost member is adapted to be attached to a mailbox post via a mailbox attachment base, while an uppermost member attaches to a mailbox itself using a mounting bracket affixed to the uppermost member. Each of the members includes a downwardly directed post that engages the member therebelow within a slot along its length. As the uppermost member is slid, the post slides along the member one below uppermost until it reaches the termination of the slot, whereafter that member begins to slide relative to the member below it using the same attachment and sliding methodology. While unique and offering an elongated extension with a condensed retracted state, the Ruocco device involves a structure that also diverges from that of ht present invention. The device includes several stacked members that function relative to one another, using multiple contact surfaces that increase overall traction and friction within the system. The present invention is adapted to minimize friction and provide a simple sliding mechanism that is detachable prior to being secured to a mailbox post, and thereafter is secured as a non-separatable assembly once installed. The present invention does not utilize several sliding layers to accomplish this task, and thus provides a slimmer, less bulky design that is less readily visible after installation.

The present invention comprises a mailbox slider mechanism having two elements slideably connected from one end and secure together at an opposite end, wherein the secured end faces the roadway and prevents a user from separating the sliding member from the base member while extending the mailbox. At least one tongue and groove slideable connection between members allows relative motion, while an outward hand allows the sliding member to be easily grasped and slid along the base member. The two-part assembly eliminates moving parts or mechanisms, while the recessed channel and stop prevents separation. Therefore it is herein submitted that the present invention substantially diverges in design elements from the prior art and consequently it is clear that there is a need in the art for an improvement to existing mailbox slider devices. In this regard the instant invention substantially fulfills these needs.

SUMMARY OF THE INVENTION

In view of the foregoing disadvantages inherent in the known types of mailbox slider devices now present in the prior art, the present invention provides a new two-part mailbox slider mechanism and handle, wherein the same can be utilized for providing convenience for the user when access rural or suburban mailboxes along roadways by extending the mailbox from its position on a standard mailbox post.

It is therefore an object of the present invention to provide a new and improved mailbox slider device that has all of the advantages of the prior art and none of the disadvantages.

It is another object of the present invention to provide a mailbox slider device comprising a first and second slideable member and a handle member for grasping and sliding the first member with respect to the other when extending and retracting an attached mailbox.

Another object of the present invention is to provide a mailbox slider device that includes a means of engaging the first and second sliding member from one end and preventing separation from a second using a recessed channel and one-way stop formed into the two member and having no moving parts.

Yet another object of the present invention is to provide a mailbox slider device that is adapted to support mailboxes of smaller and larger dimension on an existing, standard mailbox post having an exposed horizontal support, wherein the present device does not overly raise the mailbox or increase difficulty of installment onto the post.

Still another object of the present invention is to provide a mailbox slider device that reduces sliding friction by providing a simple tongue and groove sliding means and a construction that contemplates weatherproof polymer that will not corrode over time.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
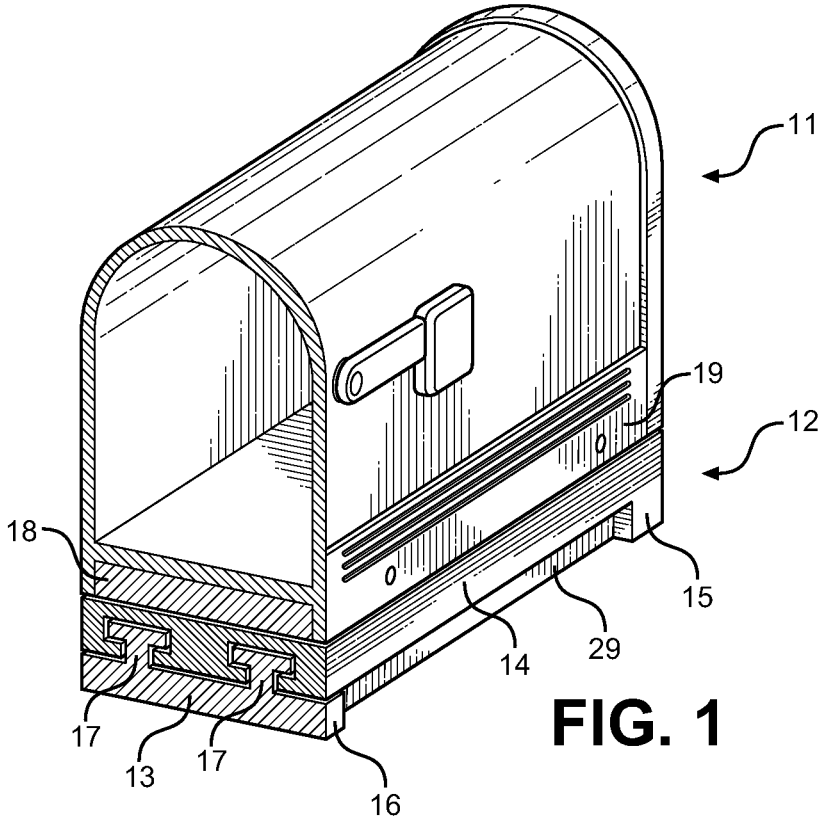
FIG. 1 shows a cross sectional perspective view of the present mailbox slider affixed to a mailbox.

Reference is made herein to the attached drawings. Like reference numerals are used throughout the drawings to depict like or similar elements of the mailbox slider device. For the purposes of presenting a brief and clear description of the present invention, the preferred embodiment will be discussed as used for supporting an existing mailbox on an existing mailbox post and providing a means of extending the mailbox therefrom using a simply designed and installed assembly. The figures are intended for representative purposes only and should not be considered to be limiting in any respect.

Referring now to FIG. 1, there is shown a cross sectional view of the present invention in a working state and attached to a mailbox assembly. The device comprises a first sliding member 14 slideably attached to a second base member 13. The sliding member 14 is adapted to connect to a mailbox 11 via a set of fasteners through the sliding member 14 and into a support board 18 beneath and attached to the mailbox 11. Connecting the two members is at least one tongue and groove joint 17 that runs lengthwise along the members and below the longitudinal axis of the mailbox 11. Along the lateral sides of the base member 13 is a recessed channel 29, which accepts the cross section of a downward tab 15 from the sliding member. The tab 15 is adapted to freely engage the proximal end of the base member 14 and slide along the channel while the tongue and groove joint maintains their relative positioning while sliding. Along the distal or forward portion of the base member, and lateral channel 29 terminates at a stop 16, which is adapted to abut against the sliding member tab 15 within the channel 29 and prevent dislodgement from the base member distal end. In this way, the two members are engagable from one end (base member proximal end) and prevented from separated from an opposite end (base member distal end).

Figure 2:
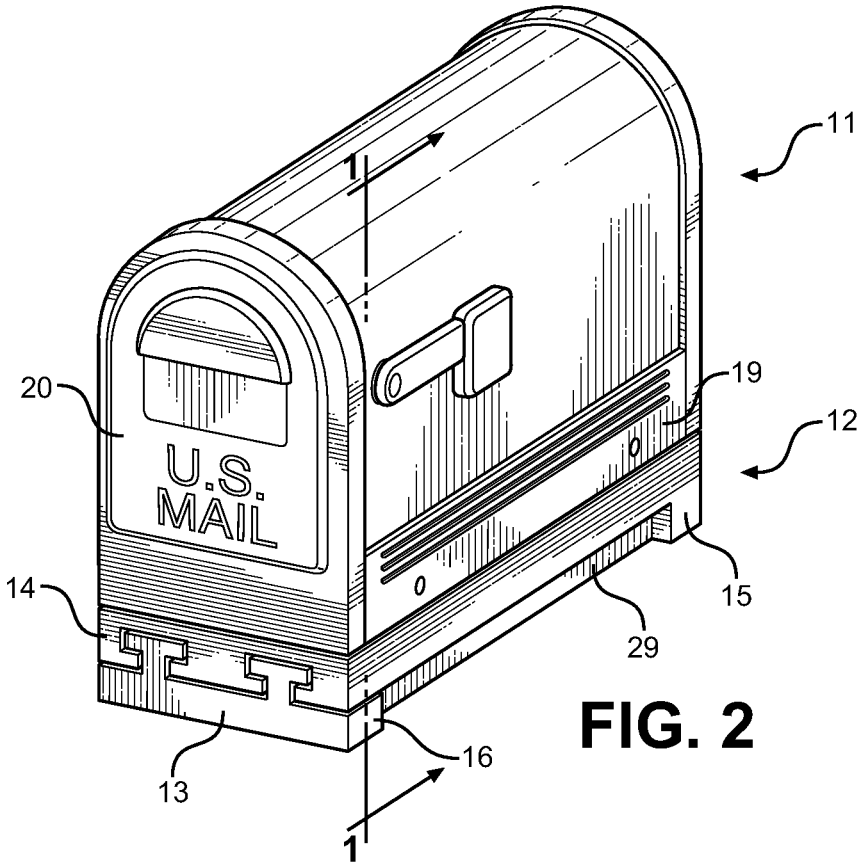
FIG. 2 shows a frontal perspective view of the present mailbox slider affixed to a mailbox and without a pull handle for visualization purposes.

Referring now to FIG. 2, there is shown a frontal perspective view of the present invention in a working state, wherein the slider device 12 is attached to a mailbox 11 and the handle means of sliding the first member is absent for visualization purposes. During assembly of the present invention, a mailbox 11 is connected to a support board therebelow using a shelf portion 19 and inwardly directed fasteners that engage the board and secure the two together. The sliding member 14 is then fastened to the support board below the mailbox using upwardly directed fasteners, which engage the board and secure the mailbox, board and sliding member 14 together. The sliding member 14 can then be slideably connected to the base member 13 via its proximal end, wherein the complimentary tongue and groove joint or joints are engaged. After connection, the mailbox 11, support board, and sliding member 14 can be slid toward the distal end of the base member 13, exposing the upper surface of the base member for fastening to be downwardly directed therethrough and into a horizontal mailbox support post. Once the base member 13 is secured, the entire assembly is secure together, wherein the proximal end of the base member 13 may be abutted against the upstanding portion of the mailbox post to prevent the two members from being separated, while the tab 15 and stop 16 of the lateral channels 29 allows relative sliding of the mailbox with respect to the base member 14 without risk of complete separation.

Figure 3:
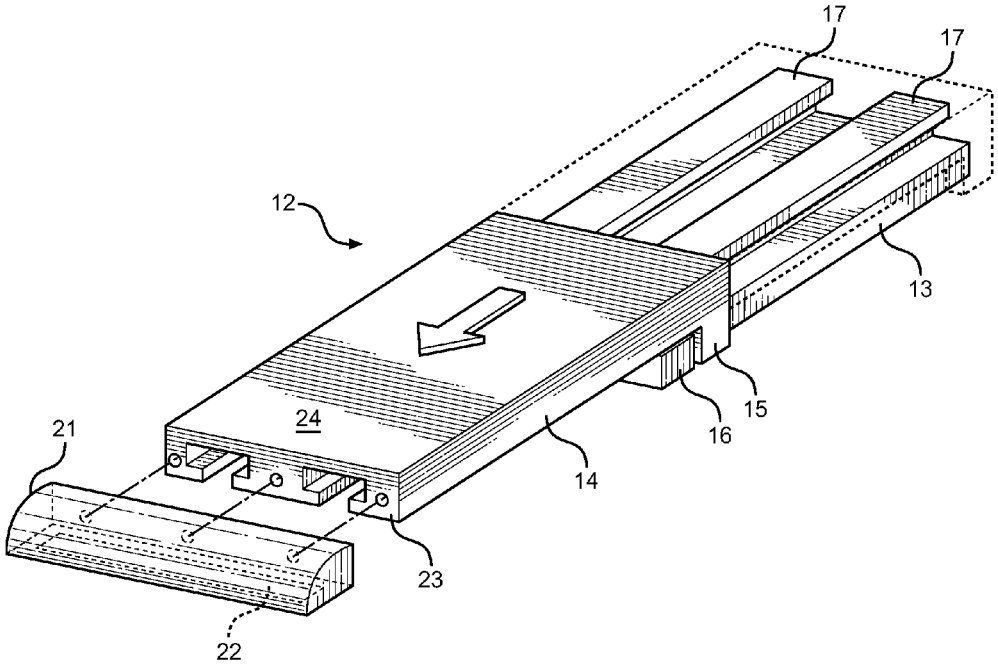
FIG. 3 shows an exploded view of the present invention and all of its elements.

Referring now to FIG. 3, there is shown an exploded perspective view of the slider mechanism 12 of the present invention. As visualized, the slider comprises of a first base member 13 slideably connected to a second slider member 14 via at least one tongue and groove joint 17 spanning the length of each member. The two members join together from the base member proximal end and are prevented from separating via the distal end of the base member by way of the lateral channel, which includes a tab 15 and stop 16 joint that prevents complete dislodgement at this end. The sliding member upper surface 24 is adapted to support the support board of a mailbox positioned thereabove, while a user handle grip 21 is adapted to connect to the forward face 23 of the sliding member and provide a user with a means to grasp the sliding member and move it relative to the base member. The handle 21 is one having a finger hold 22 that allows ready grip of the device from the outstretched hand of a user.

Figure 4:
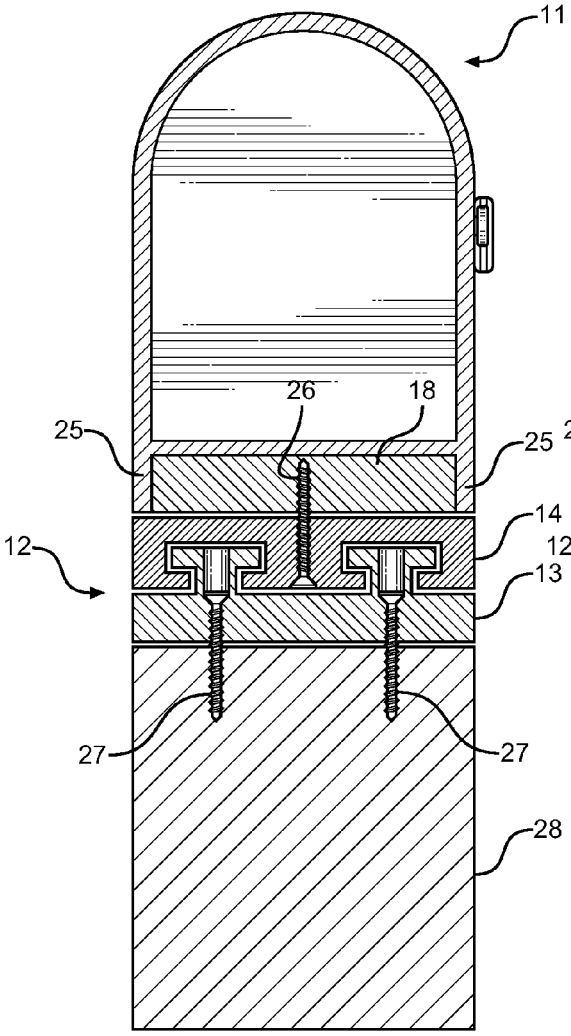
FIG. 4 shows a frontal cross section view of the present invention in use with a standard 7½ inch wide mailbox.
Figure 5:
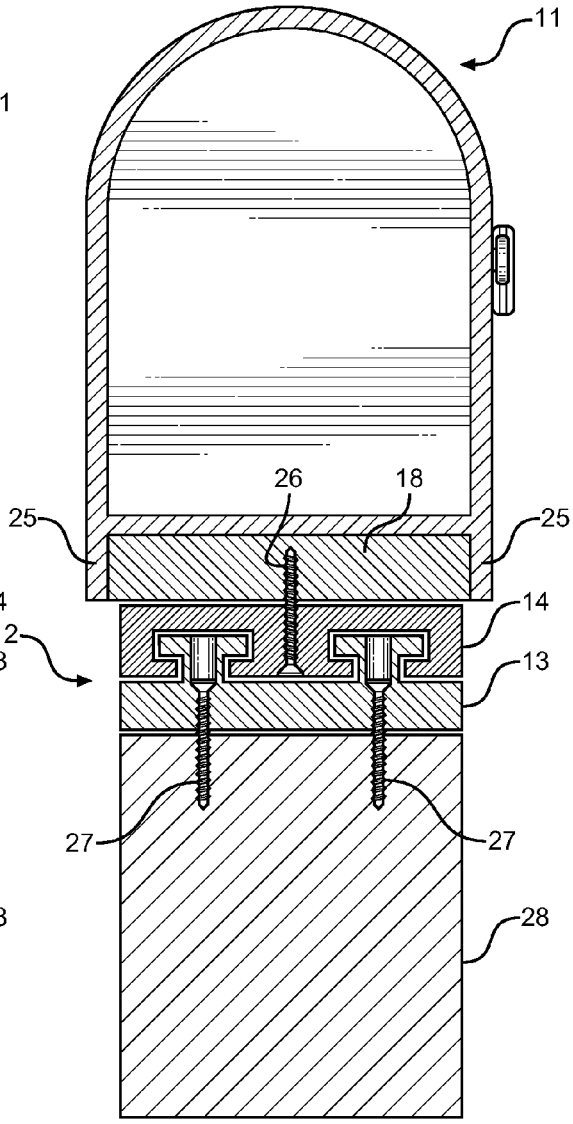
FIG. 5 shows a frontal cross section view of the present invention in use with a larger 8½ inch wide mailbox.

Referring now to FIGS. 4 and 5, there are shown two views of the present invention in a working state and secured to a mailbox support post 28. These views are presented to visualize the capability of the present invention to accommodate mailboxes 11 of varying width. Typical mailboxes are sized between 6½ inches and 8½ inches in width, wherein the mailbox is mounted using a mailbox support board 18 secured thereunder via fasteners placed through the skirt portion 25 of the mailbox. The slider device 12 of the present invention utilizes a common size to accommodate different mailbox dimensions using a common methodology. Upwardly directed fasteners 26 through the sliding member 14 connect the mailbox support board 18 to the slider 12, while downwardly directed fasteners 27 secure the base member 13 to the mailbox support post 28 along its horizontal support. These fasteners are positioned through drilled holes in the members, which may be positioned within the tongue and groove joints or along the flat, free field portions of each member, wherever deemed necessary and appropriate for the given material and dimensions of the slider.

It is desired to disclose a mailbox slider device having minimal features to reduce complexity, including no spring-loaded or moving parts, and a sliding means that is simple and low friction. The desired material for each member is a sturdy, weatherproof polymer, composite or plastic material that is readily useable outdoors throughout its lifetime and provides an inexpensive assembly for the user. Assembling the device requires the two members to be joined together along the base member distal end, while the lateral channel prevents disconnection along an opposite end. Pre-drilled fastener locations allow the assembly to be easily installed only a mailbox post and to the support board of a mailbox itself.

It is recognized that users may be required by the postal service to clear significant amounts of snow away from roadside mailboxes, such that postal workers may more readily access the mailboxes during delivery. This can be a laborious and time-consuming task, and may be particularly difficult to complete for individuals who are elderly or who suffer from health problems. As a result, mounds of accumulated and plowed snow that are not cleared away may preclude a postal worker from driving along the fringe of the roadway, which may be a snow bank. This increases the distance between postal vehicles and residential mailboxes, preventing postal workers from being able to access the mailboxes from their vehicles. Thus, the postal service may issue a written warning requiring the homeowner to clear the snow so that the postal delivery person has ease of access to the mailbox. If the homeowner does not clear away the excess snow, the postal service may suspend delivery until the snow is removed or melts. The present invention is therefore submitted as an inexpensive means of improving access to residential mailboxes, wherein the slider mechanism of the present invention provides a simply constructed and readily manufacturable device that proves low cost and of low complexity for the user to install and maintain. The sliding member is slid along the base member as the mailbox is extracted from the post, while the simple stop channel prevents any dislodgment of the two during deployment. During installation, the assembly is proximal end of the assembly is placed against the upstanding portion of the mailbox post to ensure the two do not separate in this direction as well, thereby permanently securing the members together until the user removes the secure fasteners and therefore the entire assembly from the mailbox post.

In light of the present disclose and the aforementioned prior art descriptions, it is submitted that the present invention fulfills a need in the art for a simple slider mechanism that does not include complex or moving mechanisms for operation. The present invention is a simple two-part assembly having a handle portion for operation. It is further submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A two-part mailbox slider mechanism having a handle, comprising:

a base member and a sliding member, each of said members having a proximal and distal end;

said base member adapted to secure to a horizontal portion of a mailbox post;

said sliding member positioned above said base member and slideably attaching thereto, said sliding member adapted to secure to a mailbox;

said base member and said sliding member having a slideable attachment comprising at least one tongue and groove joint spanning said base member length;

said base member having at least one lateral slide channel, said channel extending from said base member proximal end and ending short of said base member distal end at a channel stop, wherein said channel is a lengthwise cutout disposed along a horizontal axis on at least one outer side of said base member and extends parallel to said least one tongue and groove joint;

said sliding member having at least one downward tab protruding downward from a lateral side edge at said sliding member proximal end and resting within said channel and slideably engaging said channel, and wherein said least one downward tab is adapted to abut against said channel stop when said sliding member is slideably extended from said base member to prevent dislodgement from said base member distal end while providing ready joining from said base member proximal end;

a handle grip having a downwardly arcuate shape attaching across a forward face of said sliding member distal end for gripping and pulling said sliding member relative to said base member.

2. The two-part mailbox slider mechanism of claim 1, wherein said at least one tongue and groove joint comprises a first and second tongue and groove joint running parallel to one another along said base member length.

3. The two-part mailbox slider mechanism of claim 1, wherein said sliding member is further adapted to secure to a mailbox support board that is mounted on top of said sliding member upper surface.

4. The two-part mailbox slider mechanism of claim 1, wherein said base member further comprises pre-drilled fastener holes for insertion of downwardly directed fasteners through said base member and into a mailbox post, and said sliding member further comprises pre-drilled fastener holes for insertion of upwardly directed fasteners through said sliding member and into a mailbox support board.

5. The two-part mailbox slider mechanism of claim 1, wherein said base member and said sliding member are comprised of a weatherproof polymer material.

* * * * *